US005994244A

United States Patent [19]

Fujiwara et al.

[11] Patent Number: 5,994,244

[45] Date of Patent: Nov. 30, 1999

[54] NON-WOVEN FABRIC COMPRISING FILAMENTS AND AN ABSORBENT ARTICLE USING THE SAME

[75] Inventors: Toshikatsu Fujiwara; Shingo Horiuchi; Shigeyuki Sugawara, all of Shiga, Japan

[73] Assignee: Chisso Corporation, Osaka, Japan

[21] Appl. No.: 09/246,372

[22] Filed: Feb. 8, 1999

Related U.S. Application Data

[63] Continuation of application No. PCT/JP97/04164, Nov. 14, 1997.

[30] Foreign Application Priority Data

Nov. 22, 1996 [JP] Japan ..... 8-312345

[51] Int. Cl.[6] ..... B32B 5/16

[52] U.S. Cl. ..... 442/365; 442/362; 442/364; 442/401

[58] Field of Search ..... 442/362, 364, 442/365, 401

[56] References Cited

U.S. PATENT DOCUMENTS

| | | |
|---|---|---|
| 5,064,559 | 11/1991 | Ando et al. . |
| 5,126,201 | 6/1992 | Shiba et al. . |
| 5,498,468 | 3/1996 | Blaney . |
| 5,605,749 | 2/1997 | Pike et al. . |
| 5,652,051 | 7/1997 | Shawver et al. . |

FOREIGN PATENT DOCUMENTS

| | | |
|---|---|---|
| 0 579 883 | 1/1994 | European Pat. Off. . |
| 59-173312 | 10/1984 | Japan . |
| 2-169718 | 6/1990 | Japan . |
| 3-279417 | 12/1991 | Japan . |
| 3-287875 | 12/1991 | Japan . |
| 4-136252 | 5/1992 | Japan . |
| 5-005261 | 1/1993 | Japan . |
| 5-263350 | 10/1993 | Japan . |
| WO 97/30199 | 8/1997 | WIPO . |

*Primary Examiner*—Christopher Raimund
*Attorney, Agent, or Firm*—Merchant & Gould P.C.

[57] ABSTRACT

A filament non-woven fabric comprises thermally adhesive conjugated filaments comprising a first component that contains not less than 20 weight % of ethylene-acrylic ester-maleic anhydride copolymer and that is formed in at least a part of the filament surface in the longitudinal direction of the filament, and a second component that is a crystalline thermoplastic resin having a melting point higher than that of the first component. At least the first component contains an inorganic powder and the content of the inorganic powder is 500 to 50000 weight ppm with respect to filament. The present invention can provide the non-woven fabric comprising filaments which is excellent in the high adhesive property, low temperature adhesive property, adhesion property to other kinds of materials, hand feeling such as softness or touch etc., and uniformity. Furthermore, the operating efficiency such as the spinning property is desirable. Absorbent articles can be made using the above mentioned non-woven fabric comprising filaments.

10 Claims, No Drawings

NON-WOVEN FABRIC COMPRISING FILAMENTS AND AN ABSORBENT ARTICLE USING THE SAME

"This application is a continuation of international application number PCT/JP97/04164, filed Nov. 14, 1997, pending."

TECHNICAL FIELD

The invention relates to a non-woven fabric comprising filaments and an absorbent article using the same. In particular, it relates to a non-woven fabric comprising thermally adhesive conjugated filaments comprising a first component that contains not less than 20 weight % of ethylene-acrylic ester -maleic anhydride copolymer and that is formed in at least a part of the filament surface in the longitudinal direction of the filament and a second component that is a crystalline thermoplastic resin having a melting point higher than that of the first component. The invention also relates to an absorbent article using the above mentioned non-woven fabric comprising filaments.

BACKGROUND ART

A spun bond non-woven fabric is a typical example of a non-woven fabric comprising filaments. Such fabric is produced by a method wherein a group of filaments discharged from a spinneret for melt spinning are drawn and stretched by introducing into an air sucker etc., opened, and accumulated on a collecting conveyor to be formed into a filament web. Then the filaments are entangled or thermally adhered by appropriate means. Therefore, since this non-woven fabric comprises filaments, that is, continuous fibers, it is more excellent in the mechanical properties such as tensile strength etc. as compared with a non-woven fabric comprising staple fibers. Moreover, since this non-woven fabric is produced by opening and accumulating the filaments obtained directly by melt spinning, it can be rationally produced as compared with non-woven fabrics obtained by opening and accumulating staple fibers by a dry method or a wet method. In recent years, the production of such non-woven fabrics has radically increased.

Moreover, thermally adhesive conjugated fibers comprising polypropylene or polyester as a high melting point component and high density polyethylene, low density polyethylene, or linear low density polyethylene etc. as a low melting point component conventionally have been known. Such conventional thermal adhesive conjugated fiber is formed into, for example, a non-woven fabric by the method wherein a web is produced and then heated at the temperature above the melting point of the low melting point component to bond each fiber by softening or melting the portion where fibers contact each other. However, these thermal adhesive conjugated fibers are poor in bonding or adhesion to the different kind of materials such as metal, paper, rayon, glass or the like, due to the characteristics of the low melting point component of the fiber. Therefore, when the above mentioned non-woven fabric is used by bonding or adhering to the above mentioned different kinds of materials, or when the composite materials are formed by combining this non-woven fabric with different kinds materials, new binder needs to be used. Furthermore, even when a binder is used, the adhesive property is not always excellent.

Moreover, conventionally, absorbent articles of medical and sanitary materials such as disposable diapers like paper diapers, sanitary napkins and the like have structures so that body fluids such as urine, blood or the like are absorbed and the leaking is prevented. Although the structure of such absorbent articles varies between respective specific embodiments, however, such an absorbent article generally comprises an absorptive core layer for absorbing and retaining body fluids such as urine, blood or the like; a liquid permeable cover of the absorptive core layer for wrapping up the absorptive core layer; a liquid permeable top sheet located at the side of the front surface of the cover of the core layer (the side contacting with the user's skin); and a liquid impermeable back sheet located at the back side of the absorptive core layer (the side opposite to the location where the top sheet is located) to which prevent the absorbed body fluids from leaking outside, or the like. Moreover, some of the absorbent articles have a structure comprising a second sheet at the location between the cover of the absorptive core layer and the top sheet, or the location between the absorptive core layer and the cover of the absorptive core layer. The second sheet is inserted so as to provide any of the functions of: providing cushion property, dispersing body fluid, or preventing the absorbed body fluid from returning to the body side. The function of preventing the body fluid absorbed by the absorptive core layer from returning to the body side applies the principles in which the filling density of fibers of the second sheet is made to be smaller than those of the absorptive core layer, and thereby the fluid is made to be absorbed by the absorptive core layer having the larger fiber filling density by the capillary phenomenon etc. However, it is not particularly limited to this method. Besides the above mentioned structures of the absorbent articles, some of the absorbent articles have multi-layered structures because further sheets are inserted for providing various functions.

As the absorptive core layer, a compressed mixture is used in which, in general, the aggregate of fibers comprising cellulose type fiber such as fluff pulp etc. is combined with a highly water absorptive resin. Further synthetic fibers, if necessary, are additionally mixed and hardened therewith. As the liquid permeable cover for wrapping up the absorptive core layers, tissue paper is usually used. Moreover, as the top sheet, a through air non-woven fabric comprising staple fibers (a non-woven fabric produced by the method in which a part of staple fibers constituting non-woven fabric is adhered by heating with hot air) or an embossed type of non-woven fabric comprising staple fibers (a non-woven fabric produced by the method in which a part of staple fibers constituting non-woven fabric is adhered by passing it between the thermal embossing roll and a roll having a smooth surface) etc. is used. Moreover, as the back sheet, a thermoplastic film is usually used. In general, the thermoplastic film has a large number of minute micropores so as to prevent stuffiness inside in use and to provide ventilation. Moreover, from the view point of improving the plastic-like touch and appearance that are peculiar to such films, or from the viewpoint of improving the strength, the composite comprising a film and a non-woven fabric also is used. And necessary portions between the above mentioned parts of the absorbent article are adhered by using appropriate hot melt type adhesives etc.

However, the hot, melt type adhesives have stickiness, and the adhesive strength is not so strong as the case where adhered by using a pressure sensitive adhesives. Furthermore, if too much hot melt type adhesive is used, clogging in each sheet occurs, thus damaging the ventilation or deteriorating a permeability with respect to body fluid.

As to a non-woven fabric comprising filaments, in order to solve the above mentioned problems, as the component to be used for the thermally adhesive component of the non-woven fabric comprising thermal adhesive conjugated filaments, ethylene-acrylic ester-maleic anhydride copolymer having various kinds of functional groups and exhibiting an excellent adhesive property to various kinds of materials is considered to be used as one component of the conjugated filament. Such resin is excellent in adhesive property with respect to other kinds of materials, but it has a problem such as having a strong stickiness and large friction coefficient.

Therefore, there are the following problems: when filaments discharged from the spinning nozzle holes are drawn by the metallic air sucker, the non-uniformity of fineness occurs due to the friction between filaments and metal or between filaments; or filaments thermally adhere to each other and form a bundle, so that the filaments are not easily opened.

Moreover, since in the ethylene-acrylic ester-maleic anhydride copolymer, various kinds of functional groups are introduced into ethylene copolymer, the ethylene-acrylic ester-maleic anhydride copolymer has the low crystallinity, low melting point property, or low softening point property. In a case where the resin having low crystallinity is used, the time or distance for the resin filament discharged from the spinning nozzle holes in a molten state to become crystallized and solidified, namely the solidification length, becomes remarkably long.

Therefore, in such non-woven fabrics, filaments form bundles due to the friction, and non-uniformity of fineness or poor opening may occur. Moreover, the distance between filaments is short, so that filaments whose solidification length becomes long contact with each other in a molten state. That is, low melting point or a low softening point ethylene-acrylic ester-maleic anhydride copolymer portions contact with each other in a molten state, thus causing so-called filament breakage and deteriorating the operating efficiency.

JP-A-3-287875 discloses a thermal adhesive conjugated fiber in which ethylene-acrylic ester-maleic anhydride copolymer is used as a low melting point component and silicon polymer emulsion is substantially applied to the surface to reduce the friction coefficient of the fiber surface. Therefore, it is thought that if this technique is applied, even if the filament comprising ethylene-acrylic ester-maleic anhydride copolymer is used as a low melting point component, a non-woven fabric which is excellent in uniformity can easily be obtained.

However, in the technique disclosed in JP-A-3-287875, staple fibers are presumed to be used. In this case, in general, a finishing agent such as silicon polymer emulsion is applied to the fiber surface in the form of an aqueous emulsion by miffing with surface active agent. At the time of manufacturing non-woven fabrics comprising filaments, it is when filaments are drawn and stretched by the metallic air sucker that the problems tend to occur. Therefore, a finishing agent such as silicon polymer emulsion needs to be applied between the spinneret and the air sucker. However, there are the following problems: applying such a finishing agent to the group of filaments moving at high speed per se is difficult; the applied liquid is splashed in the air sucker; fibers form bundles due to the surface tension of the aqueous emulsion; and in a case where filaments are opened by providing the same electric charge by corona discharge, chargeability is deteriorated due to the finishing agent so that the opening property actually is deteriorated. In view of the above, it is inadequate to directly produce non-woven fabrics comprising filaments by means of this technique.

In other words, even in a case where this technique disclosed in JP-A-3-287875 is used, the opening property is not sufficient and formation (the uniformity of non-woven fabric) is poor, and the hand feeling such as softness or touch etc. is not sufficient. Consequently, this technique is not suitable for producing the non-woven fabrics comprising filaments.

The object of the present invention is to avoid the above mentioned problems and to provide a non-woven fabric comprising filaments comprising conjugated filaments having an excellent adhesive property. A low temperature adhesive property and an excellent adhesive property to other kinds of materials; providing the resultant non-woven fabric comprising filaments with an excellent hand feeling such as softness or touch etc, and the uniformity of the non-woven fabric; and having a high operating efficiency such as spinning property.

Another object of the present invention is to avoid the above mentioned problems of the conventional absorbent articles and by using the above mentioned non-woven fabric comprising filaments in at least one portion of the absorbent article to provide an absorbent article which is free from clogging, which is excellent in adhesive property, and which is well adhered to other members so that layers constituting the absorbent articles are not peeled off and do not lose shape in use.

The present inventors found that by addition of inorganic powders to at least the first component that is a low melting point component or low softening point component, the inorganic powder is exposed at the surface of filaments, so that minute unevenness is provided on the surface of filaments. As a result, the area where the filaments contact with each other is reduced, and adhesion between the filaments during spinning can be inhibited, so that filament breakage is decreased to thus make the operating efficiency good. It also was found that even if inorganic powder is added, the crystallization temperature of ethylene-acrylic ester-maleic anhydride copolymer hardly increases and the increase in the crystallization is remarkably small, and therefore a non-woven fabric comprising filaments which is excellent in hand feeling such as softness or touch etc. can be obtained without damaging the properties of ethylene-acrylic ester-maleic anhydride copolymer, that is, softness, an excellent adhesion property, low temperature adhesion properties and excellent adhesive property to other kind of materials etc. It also was found that when such non-woven fabric comprising filaments is used for at least a part of the absorbent article, an absorbent article which is free from clogging, is excellent in adhesive property, and is well adhered to other members so that layers constituting the absorbent articles are not peeled off and do not lose shape in use can be obtained.

DISCLOSURE OF THE INVENTION

The present invention provides the filament non-woven fabric comprising thermal adhesive conjugated filaments comprising a first component that contains not less than 20 weight % of ethylene-acrylic ester -maleic anhydride copolymer and that is formed in at least a part of the filament surface in the longitudinal direction of the filament and a second component that is a crystalline thermoplastic resin having a melting point higher than that of the first component. At least the first component contains an inorganic powder and the content of said inorganic powder is 500 to 50000 weight ppm with respect to the filament.

It is preferable in the non-woven fabric comprising filaments of the present invention that the copolymerizing composition of ethylene-acrylic ester-maleic anhydride copolymer has a copolymerizing ratio of maleic anhydride of 2 to 5 weight % and a copolymerizing ratio of acrylic ester of 6 to 30 weight %.

It is also preferable in the non-woven fabric comprising filaments of the present invention that a melting point of ethylene-acrylic ester-maleic anhydride copolymer is in the range of 60 to 110° C.

It is further preferable in the non-woven fabric comprising filaments of the present invention that a resin component of the first component is a mixture of ethylene-acrylic ester-maleic anhydride copolymer and polyethylene.

It is further preferable in the non-woven fabric comprising filaments of the present invention that the average particle diameter of the inorganic powder is in the range of 0.04 to 2 $\mu$m.

It is further preferable in the non-woven fabric comprising filaments of the present invention that the inorganic powder is at least one inorganic powder selected from the group consisting of titanium dioxide, silica, alum, calcium carbonate, calcium oxide, magnesium oxide and talc.

It is further preferable in the non-woven fabric comprising filaments of the present invention that the crystalline thermoplastic resin of the second component is polypropylene.

It is further preferable in the non-woven fabric comprising filaments of the present invention that the crystalline thermoplastic resin of the second component is polyethylene terephthalate.

It is further preferable in the non-woven fabric comprising filaments of the present invention that the non-woven fabric comprising filaments is obtained by the spun bond method.

Further, absorbent articles of the present invention are the absorbent articles that use the above mentioned non-woven fabric comprising filaments in at least a part of the absorbent articles.

BEST MODE FOR CARRYING OUT THE INVENTION

The non-woven fabric comprising filaments of the present invention comprises thermally adhesive conjugated filaments comprising a first component that contains not less than 20 weight % of ethylene-acrylic ester -maleic anhydride copolymer and in which the first component is formed in at least a part of the filament surface in the longitudinal direction of the filament and a second component that is a crystalline thermoplastic resin having a melting point higher than that of the first component; wherein at least the first component contains an inorganic powder and the content of said inorganic powder is 500 to 50000 weight ppm in the concentration with respect to the filament.

Filament means that short fibers such as staple fiber etc. are not included and that long fibers such as continuous fiber etc. are included.

As the above mentioned thermal adhesive conjugated filament comprising resin which contains not less than 20 weight % of ethylene-acrylic ester-maleic anhydride copolymer and which is formed in at least a part of the filament surface in the longitudinal direction of the filament as a first component and a crystalline thermoplastic resin having a melting point higher than that of the first component as a second component, the following conjugated filaments are preferably used: a core and sheath type conjugated filament in which the first component is a sheath component and the second component is a core component; a so-called eccentric core and sheath type conjugated filament in which the location of the core component is eccentric in the cross section of the core and sheath type conjugated filament; and a so-called parallel type conjugated filament (a side-by-side type conjugated filament) in which the first component and the second component are adhered to each other. In particular, it is preferable that the eccentric core and sheath type conjugated filament or the parallel type conjugated filament are used, since crimped filaments can easily be obtained and a non-woven fabric that has a high bulkiness and good hand feeling can be obtained. The ratio (conjugating ratio) of the first component to the second component in the cross section of the parallel type conjugated filament may be 1 : 1 or, needless to say, one component may occupy a greater portion than the other component in the cross section of the filament.

The volume ratio of the first component to the second component (which corresponds to the area ratio in the cross section, if the cross section of fiber is employed, that is, the conjugating ratio) is usually in the range of 10 : 90 to 90 : 10 expressed in the ratio of the first component to the second component. More preferably, it is in the range of 30 : 70 to 70 : 30.

As the resin component used for the first component in the present invention, resin containing not less than 20 wt. % of ethylene-acrylic ester-maleic anhydride copolymer is used.

As the ethylene-acrylic ester-maleic anhydride copolymer, the copolymer comprising maleic anhydride in an amount (in other words, the copolymerizing ratio of maleic anhydride) of about 2 to 5 wt. %, and acrylic ester in an amount (in other words, the copolymerizing ratio of acrylic ester) of about 6 to 30 wt. % is preferably used. In general, ethylene-acrylic ester-maleic anhydride terpolymer is used, but other components may be copolymerized to some extent as long as they do not hinder the object of the invention. The ethylene-acrylic ester-maleic anhydride terpolymer comprising maleic anhydride in the ratio of about 2 to 5 wt. % and acrylic ester in the ratio of about 6 to 30 wt. % is preferred since in such a terpolymer the melting point is not too low, or stickiness is not too strong. Thus the requirements for a material constituting the surface of filament are satisfied. The thermal stability is relatively excellent, so that thermal decomposition and deterioration in quality at the time of the melt spinning does not occur. Furthermore the thermal adhesive property to other kinds of materials is excellent.

In the present invention, as the ethylene-acrylic ester-maleic anhydride copolymer, the one having the melting point in the range of 60 to 110° C. is preferably used because the excellent spinning property and adhesive property can be obtained.

The acrylic ester which constitutes the above mentioned ethylene-acrylic ester-maleic anhydride copolymer used in the present invention is not particularly limited, but, in general, copolymers using ethyl acrylate, butyl acrylate or the like are widely used from the industrial view point. Such copolymers are easily available and preferably used. Moreover, in the field where problems occur in terms of bad smell or food sanitary affairs because of a free alcohol component derived form the acrylic ester component, ethyl acrylate whose smell is not too strong and which is registered in "the standard self imposing controls regarding food packages made of synthetic resin such as polyolefin etc" by the Sanitary Conference on polyolefin etc. is preferably used.

In the resin component constituting the first component, ethylene-acrylic ester-maleic anhydride copolymer needs to be included in an amount of not less than 20 wt. % based on the total weight of the resin component of the first component, which is necessary for keeping the low temperature adhesive property or adhesion to different kinds of materials excellent. When the content of the ethylene-acrylic ester-maleic anhydride copolymer is less than 20 wt. %, it is not preferable since the above mentioned properties cannot sufficiently be exhibited. The ethylene-acrylic ester-maleic anhydride copolymer can be used up to the ratio of 100 wt. % with respect to the total weight of the resin component of the first component. However, if necessary, other resins having relatively low melting point or low softening point can be mixed as long as melt spinning can be conducted.

The examples of the resin having relatively low melting point or low softening point that can be mixed with ethylene-acrylic ester-maleic anhydride copolymer in the first component include; polyethylene, polypropylene, ethylene-propylene copolymer, ethylene-butene-propylene copolymer, low melting point polyester, low melting point polyamide and the like. Among these resins having a relatively low melting point or low softening point, polyethylene is preferred from the viewpoint of obtaining the compatibility and low melting point temperature. As polyethylene, various kinds of polyethylene can be used, and the examples of polyethylene that preferably can be used include high density polyethylene, low density polyethylene, linear low density polyethylene etc. Moreover, if polyethylene is used along with ethylene-acrylic ester-maleic anhydride copolymer, the friction with metal of the above mentioned air sucker etc. can be reduced and adhesion between filaments more preferably can be prevented in melt spinning.

As the resin component of the first component that contains not less than 20 wt. % of ethylene-acrylic ester-maleic anhydride copolymer of the present invention, any one can be used as long as it can exhibit the thermal adhesive property by thermally melting or softening at a lower temperature than the crystalline thermoplastic resin of the second component. Preferably, the resin that can be thermally melted or softened at a temperature lower by not less than 5° C. than the temperature where the crystalline thermoplastic resin of the second component is thermally melted, more preferably at a temperature lower by not less than 30° C. is preferred, since they do not cause thermal damage to the physical qualities of the second component when the obtained filament fleece is thermally adhered.

As the crystalline thermoplastic resin of the second component used in the present invention, the resin that has a higher melting point than the resin containing ethylene-acrylic ester-maleic anhydride of the first component and that is capable of conjugate spinning together with the first component is used. As preferable examples, polypropylene or polyethylene terephthalate can be mentioned. It is preferable that polypropylene is used as the second component, since relatively flexible non-woven fabric comprising filaments can be produced. It is preferable that polyethylene terephthalate is used as the second component, since the non-woven fabric comprising filaments having a greater strength and more excellent elasticity (cushion property) when the crimps are provided can be obtained.

MFR (melt flow rate) of the resin that is used herein is not particularly limited, however, MFRs of both the first component and the second component, wherein olefin resin is used as the second component, are usually in the range of 10 to 100 g/10 min. In addition, in a case where a resin of the second component is olefin polymer, any polymer can be used, for example, the resin polymerized by the use of Ziegler-Natta catalyst or polymerized by the use of so called metallocene catalyst or the like can be used.

As the inorganic powder used in the present invention, any types of inorganic powder can be used as long as it can provide unevenness to the surface of the filament and prevent sticking between filaments.

The average particle diameter of the inorganic powder is preferably in the range of 0.04 to 2 $\mu$m, more preferably in the range of 0.04 to 1 $\mu$m. If the inorganic powder whose particle diameter is too small is used, the cost becomes higher, clogging of filter or spinning nozzle occurs, or the filament breakage occurs to cause deterioration in the operating efficiency because the secondary coagulation is easily generated. On the other hand, if the particle diameter is too large, the dispersion of the inorganic powder is bad and the operating efficiency tends to deteriorate due to the occurrence of the clogging of the filter or spinning nozzle, or the filament breakage. Consequently, the above mentioned range of the particle diameter is particularly preferred. The particle diameter of the inorganic powder can be measured by observation with an electron microscope. For example, when the particle diameter of the inorganic powder contained in the conjugated filament is measured, the conjugated filaments are heated under vacuum to separate the inorganic powder from the polymer that constitutes the conjugated filament, and then the inorganic powder is measured by the use of an electron microscope. At this time, in a case where the shape of the particle is different from spherical shape, the particle diameter is determined by converting to the particle diameter of a spherical shaped particle having an equal volume to the particle in question.

As specific examples of the inorganic powder used in the present invention, a wide variety of stable and inactive inorganic powders, for example, titanium dioxide, silica, alum, calcium carbonate, calcium oxide, magnesium oxide, talc etc. can be used. These inorganic powders can provide the minute unevenness to the surface of the conjugated filament. As a result, the adhesion between filaments during spinning can be prevented. Thus, in the non-woven fabric comprising filaments, for example, spun bond non-woven fabric or the like, as mentioned above, the uniformity of fineness or opening property is excellent and filament breakage is improved and operating efficiency is enhanced. Moreover, these inorganic powders have a relatively small nucleating property, so that a non-woven fabric that is excellent in hand feeling such as softness or touch etc. and adhesion to the other members can be obtained, while the properties such as softness, excellent adhesive property, low temperature adhesive properties etc. of the low melting point or high adhesive resin component containing ethylene-acrylic ester-maleic anhydride of the first component are not damaged. In particular, titanium dioxide, silica, alum, calcium carbonate, calcium oxide, magnesium oxide and talc are preferred since they have small nucleating properties. Pure type inorganic powders may be used, however, the use of the pure type inorganic powder makes the cost higher. Therefore, inorganic powder including impurities may be used as long as the object of the present invention is not hindered. Moreover, in titanium dioxide, there are rutile type titanium dioxide and anatase type titanium dioxide and the both can be used. However, from the view point of an excellent weatherability and heat resistance, the rutile type titanium dioxide is preferred. Moreover, the inorganic powder needs to be added into at least the first component and may be added into both the first and second components.

The inorganic powder may be introduced from the side feeder that is provided at an extruder and kneaded with melt extrusion. In addition, the inorganic powder may be added in the form of a compound that is previously kneaded with, for example, the first component or in the form of masterbatch. When this inorganic powder is kneaded, in general, appropriate dispersing agents are used so as to enhance the dispersing property.

It is necessary that the content of inorganic powder is contained in the filament in the range of 500 to 50000 weight ppm. If the content of inorganic powder is smaller than the above range, the adhesion preventing effect between filaments during spinning due to minute unevenness on the surface of the filament is not sufficiently exhibited, so that filaments form bundles by friction, to thus cause the non-uniformity in fineness or poor opening of filaments and deterioration of the operating efficiency due to filament breakage. If the content of the inorganic powder is much more than the above range, operating efficiency tends to be deteriorated easily due to the occurrence of the clogging of the filter or spinning nozzle, or filament breakage. Moreover, in particular, in a case where the non-woven fabric comprising filaments of the present invention is used for sanitary napkins, it is preferable that the content of inorganic powder is not more than 12000 weight ppm in the total weight.

As to the content of the inorganic powder, "the concentration with respect to the filaments" denotes, in the case of the conjugated filament the concentration with respect to the entire filament. Therefore, even if inorganic powder is added only to the first component, the concentration denotes the average concentration of the entire conjugated filament comprising the first component and the second component.

In the present invention, the fineness of the conjugated filament constituting the non-woven fabric is not particularly limited. The fineness is determined appropriately in accordance with the type of resin materials or intended use of the non-woven fabric. Preferably, the fineness is approximately 1 to 8 d/f When being used for hygienic goods such as sanitary napkins, incontinence pads, operation clothes, surgical comforter having an opening portion for surgical site, base clothes for a cataplasm or the like, the fineness is preferably in the range of 1 to 5 d/f.

The basis weight of the non-woven fabric comprising filaments of the present invention also is not particularly limited. It may be determined appropriately in accordance with the types of the resin material to be used or the intended use of the non-woven fabric. Preferably, the basis weight is approximately 10 to 50 g/m$^2$. In particular, in a case where the non-woven fabric are used for sanitary materials, it is preferably about 10 to 30 g/m$^2$.

The non-woven fabric comprising filaments of the present invention can be produced by the conjugated filaments spun out of the spinneret by melt spinning by the use of the above explained resin composition of the first component and the resin composition of the second component. However, such non-woven fabric comprising filaments easily can be produced by the well known spun bond method.

Since the spun bond method is well known, the detailed explanation will be omitted. For example, the spun bond non-woven fabric comprising filaments is be produced by the following manner: the mixture of the low melting point resin component containing not less than 20 wt. % of ethylene-acrylic acid-maleic anhydride copolymer and the inorganic powder is prepared as the first component, and crystalline thermoplastic resin (if necessary, crystalline thermoplastic resin in which inorganic powder is mixed may be used) is prepared as the second component; these resin compositions are fed into the individual extruders and melted and spun by the use of the composite spinneret. A group of discharged filaments from the spinneret are introduced into an air sucker to be stretched by drawing to form into a group of filaments. Then the group of filaments discharged out of the air sucker is electrically charged with the same electric charge by the use of an appropriate electrical charging apparatus such as corona discharging apparatus etc., and then the filaments are made to pass between a couple of vibrating wing-like tools (flaps) for an opening to open the filaments, or they are made to impact on an appropriate reflecting board etc. to open filaments. The group of the opened filaments is accumulated as filament fleeces on an endless net conveyor having a sucker on its back face. The collected filament fleeces are carried on the endless conveyor, introduced between the pressed rolls of the point bond processor comprising a heated embossing roll and smooth surface roll. Thereby the non-woven fabric comprising filaments in which the first component is melted or softened and the filaments are thermally adhered is obtained at the portion corresponding to the convex portion of the embossing roll. The basis weight of the filaments non-woven fabric can be adjusted by adjusting the spinning discharging rate (discharging volume per hour) or the moving rate of the endless conveyor. Moreover, the formation method where the filament fleeces are formed into the non-woven fabric is not limited to the point bond method alone, and other methods, for example, hot air heating method, high pressure water stream method, needle punching method, ultrasonic heating method or the like may be used. The combination of such methods for forming the non-woven fabric can be employed.

Moreover, the method for producing the non-woven fabric comprising filaments of the present invention is not limited to the above explained methods. However, the spun bond method is preferred since a non-woven fabric that is excellent in the mechanical properties such as tensile strength easily can be obtained. Moreover, it is preferable that the non-woven fabric can be obtained by opening and accumulating by the use of the filaments as it is obtained by the method of melt spinning, so that the productivity is very excellent and can be produced at a low cost.

The non-woven fabric comprising filaments of the present invention thus manufactured is excellent in adhesive property, low temperature adhesive property, adhesive property to the different kind of materials; good in softness, hand feeling such as touch etc., and uniformity of the non-woven fabric. Furthermore, it is excellent in operating properties such as the spinning property. Consequently, such non-woven fabric comprising filaments can be used for various applications, and in particular, in a case of forming the composite materials by bonding or adhering with other materials, it can easily be thermally adhered. Therefore it can effectively be used for the production of such composite materials using this non-woven fabric.

Moreover, the non-woven fabric comprising filaments of the present invention can be used for at least a part of the absorbent articles such as sanitary napkins, disposable diapers or the like.

Absorbent articles such as disposable diapers, sanitary napkins and the like have structures so that body fluids such as urine, blood or the like are absorbed and the leaking is prevented. Although the structure of such absorbent articles varies between specific embodiments, however, such an absorbent article generally comprises an absorptive core layer for absorbing and retaining body fluids such as urine, blood or the like; a liquid permeable cover of the absorptive core layer for wrapping up the above mentioned absorptive core layer; a liquid permeable top sheet located at the side of the front surface of the cover of the core layer (the side contacting with the user's skin); and a liquid impermeable back sheet located at the back side of the absorptive core layer (the side opposite to the location where the top sheet is located) that prevents the absorbed body fluids from leaking outside, or the like. Moreover, some of the absorbent articles have a structure comprising a second sheet at the location between the cover of the absorptive core layer and the top sheet, or the location between the absorptive core layer and the cover of the absorptive core layer. The second sheet is inserted so as to provide any of the functions of a cushion property, dispersing body fluid, or preventing the absorbed body fluid from returning to the body side. Besides the above, some of the absorbent article have a multi-layered structure because further sheets are inserted for providing various functions. Since the non-woven fabric comprising filaments of the present invention is excellent in adhesion property to other materials, it can preferably be used for, for example, the cover of the absorptive core layer or the second sheet, or a member to be inserted in the middle of the core layer, wherein the absorbent articles are thermally pressed or thermally adhered so as to make absorbent articles thin, or to prevent the top sheet from loosening from the fiber bases and attaching itself to the private region of the body. In a case where the non-woven fabric comprising filaments of the present invention is used in the above mentioned absorptive core layer, it is inserted in the middle of the core layer and thermally adhered, so that, without much damage to the absorptive property of the absorptive core layer, it can function for reinforcing to prevent the absorptive core layer from losing shape when the stress is applied by the physical motion in a state where it is subjected to the weight of the body. Moreover, in thermally pressing or thermally adhering, although it depends on the portion to be used, the partially dot-like thermal adhesion is preferably employed, wherein a large number of dot-like adhesions can be conducted.

Hereinafter, the invention will be explained with reference to Examples and Comparative Examples but is not limited to them alone.

EXAMPLES 1 TO 8 AND COMPARATIVE EXAMPLES 1 TO 4

Ethylene-acrylic ester-maleic anhydride terpolymer or a mixture of ethylene-acrylic ester-maleic anhydride terpolymer and other resin (except for the case where the using ratio (wt. %) of ethylene-acrylic ester-maleic anhydride terpolymer in she column of the first component (A) in Table 1 is 100 wt. %, the residual part other than the using ratio of the above mentioned terpolymer is the using ratio of the other resin) and inorganic powder for mixing with the resin component of the first component shown in Table 1 were prepared as the first component. Moreover, the containing ratio of the inorganic powder of Table 1 is described as the previously defined concentration with respect to the whole filament. Therefore, the concentrations of inorganic powder contained only in the first component are higher than the concentrations shown in Tables. (The concentration of the inorganic powder contained only in the first component can easily be calculated from the concentration with respect to the filaments and the conjugating ratio.) Moreover, as the second component, crystalline thermoplastic resin shown in Table 1 was prepared. Moreover, in Comparative Example 4, single filament comprising only the second component, that is, polypropylene was used. These resin compositions were respectively fed into the individual extruders of 60 mm ϕ and extruded in a manner in which the total volume of both components was set at the rate of 2200 cc/min in accordance with the conjugating ratio of the first component to the second component (specifically, in a case where the conjugation ratio A / B of the first component (A) to the second component (B) was 50 / 50, the extruding ratio of the first component was 1100 cc/min, and the extruding ratio of the second component was 1100 cc/min) The extruding temperatures were as follows: the extruding temperatures of the first components were the temperatures shown in Table 1; the extruding temperature of the second component was 250° C. in the case of using polypropylene (also in Comparative Example 4, it was 250° C.); and 280° C. in the case of using polyethylene terephthalate. For melt spinning, as shown in the column of conjugation types of filaments in Tables, parallel type, core and sheath type, or eccentric core and sheath type, were used respectively. As the spinneret, the spinneret having circular spinning holes of 0.35 mm in hole diameter and having an orifice pattern arranged in 550×5 (there are 6 columns each of which has 550 holes in the orifice pattern) in the longitudinal direction of the spinneret was used. The group of filaments discharged from the spinneret were introduced into an air sucker to be stretched by drawing, to thus produce a group of filaments. And then, the group of filaments discharged from the air sucker was electrically charged with the same electric charge with a corona discharging apparatus, and made to pass between a couple of vibrating wing-like tools (flaps) to open the filaments. A group of the opened filaments was collected as filament-fleeces on the endless net conveyor having suckers on its back surface. At this time, the stretching speed of the air sucker was appropriately controlled in accordance with the type of filaments so as to adjust the fineness of the filaments to be 2.2 d/f. Moreover, the concentration of the inorganic powder with respect to the filament was as shown in the Table. The collected filament fleece were carried on the endless net conveyor and introduced between the pressed rolls of the point bond processor comprising a heated embossing roll and a smooth surface roll. The introduced filament fleece was formed into the non-woven fabric composed of filaments in which the filaments were thermally melted and adhered at the portion corresponding to the convex part of the embossing roll by melting or softening the first component. The basis weight of the non-woven fabric comprising filaments was controlled to 30 g/m$^2$ by adjusting the moving speed of the endless net conveyor around 50 m/min in accordance with the fiber types. Moreover, the peripheral velocity of the embossing rolls was made to be the same as the moving speed of the endless net conveyor. The linear load between rolls and the roll temperature were appropriately set in a manner in which the average value of the bending resistance in the longitudinal and vertical direction (under the 45° cantilever method specified in "A" method of JIS L 1096, wherein the size of the sample was 5 cm×15 cm) of the non-woven fabric comprising filaments was appropriately made to be about 35 mm. The conditions where the point bond process satisfies the above conditions are not particularly limited, but the following conditions are applied: the linear load between rolls is in the range of 30 to 120 (Kgf /cm); and the heating temperature of the rolls is in the range of 80 to 135 (° C.).

Moreover, every type of formation of the non-woven fabric (thermal adhesion between filaments) in the Examples was conducted by the point bond method for conforming the conditions at the time of the sensory analysis. The method of producing the non-woven fabric may be hot air heating method, high water pressure method, needle punching method, ultrasonic heating method and the combination of a plurality of the above mentioned methods.

In a case where polypropylene was used as the second component, polypropylene having MFR (melt flow rate measured under the condition 14 of the Table 1 specified in JIS K 7210) of 35 was used. Moreover, in a case where polyethylene terephthalate was used as the second component, polyethylene terephthalate having IV (intrinsic viscosity) of 0.63 and melting point of 255° C. was used. The measurement of the IV value was conducted by the use of the mixture comprising an equal weight amount of phenol and tetrachloroethane as a solvent at 20° C. Moreover, MI (melt index) of each polyethylene used as the first component was measured by the condition 4 of Table 1 specified in JIS K 7210.

Moreover, the average particle diameters of inorganic powders shown in Table 1 were: the average particle diameter of silica was 0.04 μm; $TiO_2$ was 0.20 μm; alum was 0.95 μm; $CaCo_3$ was 0.08 μm; CaO was 0.35 μm; MgO was 0.17 μm; and talc was 0.40 μm. Moreover, as $TiO_2$, rutile type titanium dioxide was used. In addition, PP of the second component denotes polypropylene; and PET of the second component denotes polyethylene terephthalate in Table 1. As to the volume ratio, A/B written in the column of the conjugating ratio, A denotes the first component, B denotes the second component and the entire value of the conjugated fiber was made to be 100.

The evaluation results of the non-woven fabrics comprising filaments obtained in the above mentioned manner were shown in Table 2.

Moreover, the measurement method for each evaluation item and the evaluation standard are as follows.

(Adhesion Strength with Other Materials "Peeling Strength") Samples (non-woven fabrics comprising filaments) obtained by each Example and Comparative Example and samples comprising other material to be adhered with the non-woven fabrics were respectively cut in the size of 10 cm×5 cm. These samples were overlapped in a manner in which four corners were corresponded. A long thin heat seal was applied to the overlapped samples in the direction of the short length of the sample, that is, in the direction of the width of the samples. The location where the heat seal was applied was the portion ranging from 1 cm inside the edge of the short side of the sample to 2 cm inside this short side of the sample. In other words, a 1 cm wide margin on which the heat seal is not applied was provided parallel to the short side of the sample, and the 1 cm wide heat seal was applied next to the margin parallel to the short side of the sample. The conditions of the heat seal were: at 150° C. (both the upper and lower parts of the heating apparatus), at 3 kg/cm$^2$, and for 5 seconds. As the heat seal apparatus, "Heat Seal Tester TP-701" (the product of TESTER SANGYO) was used.

The sample for the tensile test obtained by the above mentioned operation, was opened from the edge of the other side where the heat seal was not applied, and each edge was set between chucks located at 10 cm intervals in the Tensilon tensile tester ("RTM-100" the product of TOYO BALDIN CO., Ltd.) in a manner in which the samples were not twisted. The measurement of the peeling strength was conducted at the tension speed of 10 mm/min. The calculating method was based on the condition specified in JIS L 1086-1983.

(Bending Resistance)

Bending resistance was measured by the 45° cantilever method under the conditions specified in "A" method of JIS L 1096. The value of the bending resistances in the longitudinal and vertical directions were measured, and the average value thereof was calculated. Moreover, the size of the sample was made to be 5 cm×15 cm. Moreover, as mentioned above, in order to adjust the conditions at the time of the sensory analysis such as hand feeling etc., the binding resistance was uniformly adjusted to be around 35 mm by conducting the thermal adhesion between filaments by the point bond method. Therefore, the values are not shown in Table 2.

(UNIFORMITY INDEX OF NON-WOVEN FABRIC COMPRISING THE FILAMENTS)

Five 5×5 cm samples were taken out from the non-woven fabric at equal intervals in the transverse direction, and cut into 1×1 cm pieces and the weight of each of the pieces was measured. Each of five samples was evaluated by the following equation to calculate the average value of five samples: ((the maximum value)−(the minimum value))×100 / (the average value). The value was used as the parameters of non-uniformity of opening or non-uniformity of fineness. The smaller this value is, the more uniform the non-woven fabric is. When this value is not more than 80, the non-woven fabric may be thought to be excellent in the uniformity.

(Hand Feeling)

Sensory analysis was conducted on feeling by hand touch feeling of non-woven fabric comprising filaments by 10 monitors. As to the testing method, the monitors grasped a sample and recorded whether or not they felt that it was soft or had good feeling, and a sample recorded to be a material which was soft or had a good feeling was given one point per one person.

(Spinning Property)

The number of occurrences of filament breakage during three-hour melt spinning was measured. If it is not more than 3 times, the spinning property may be thought to be good.

(Measurement Method of Melting Point)

Melting points can be measured by using DTA (differential thermal analysis) apparatus or DSC (differential scanning calorimeter) apparatus, but, in the present invention, DSC apparatus was employed. In the present invention, the value measured by the below mentioned method was defined as a melting point.

The weight of the test piece was approximately 0.4 mg. The measurement of the weight was conducted to a 0.01 mg level. A container for a sample used herein was made of aluminum. The aluminum container had a uniform thickness and a purity of 99.9 to 99.99%. Samples were placed thinly in the center of the container, and pressed to the bottom of the container in order to remove air existing between sample and the bottom surface of the container at the predetermined pressure. As an atmospheric gas, nitrogen gas was used, and oxygen or water were removed. The heating speed was made to be 10° C. /min, and the measurement was conducted without previous specific heat treatment, such as, melting the samples in advance etc. The melting temperature was measured based on the conditions specified in JIS K 7121-1987.

TABLE 1

| No. | Second component (B) | First component (A) Copolymer | Weight % | Resin mixture | Inorganic powder | Weight ppm | Extruding temperature | Conjugation type of filament | Volume ratio of sheath to core (A/B) |
|---|---|---|---|---|---|---|---|---|---|
| Ex. 1 | PP | EH1 | 100 | — | silica | 1500 | 180 | C & S | 50/50 |
| Ex. 2 | PP | EH1 | 50 | HDPE | alum | 10000 | 210 | C & S | 40/60 |
| Ex. 3 | PP | EH1 | 30 | LDPE | $TiO_2$ | 25000 | 200 | C & S | 80/20 |
| Ex. 4 | PP | EH2 | 50 | LDPE | $CaCO_3$ | 35000 | 200 | E.C & S | 60/40 |
| Ex. 5 | PP | EH2 | 25 | LLDPE | MgO | 8000 | 220 | parallel | 30/70 |
| Ex. 6 | PP | EH3 | 100 | — | CaO | 5000 | 180 | E.C & S | 70/30 |
| Ex. 7 | PET | EH3 | 50 | HDPE | talc | 1500 | 210 | parallel | 50/50 |
| Ex. 8 | PET | EH4 | 75 | HDPE | silica | 500 | 210 | C & S | 40/60 |
| Ex. 9 | PET | EH4 | 25 | LLDPE | $TiO_2$ | 20000 | 220 | E.C & S | 60/40 |
| Co. Ex. 1 | PP | EH1 | 100 | — | — | — | 180 | C & S | 50/50 |
| Co. Ex. 2 | PP | EH2 | 50 | HDPE | $TiO_2$ | 300 | 210 | E.C & S | 50/50 |
| Co. Ex. 3 | PET | EH3 | 15 | LLDPE | Silica | 100000 | 220 | parallel | 50/50 |
| Co. Ex. 4 | PP | — | — | HDPE | — | — | 220 | C & S | 50/50 |

*Ex. = Example
Co. Ex. = Comparative Example
C & S = core and sheath type conjugated filament
E.C & S = eccentric core and sheath type conjugated filament

TABLE 2

| No. | Spinning property: Filament breakage Times/3 hrs | Non-woven fabric: Uniformity Index | Non-woven fabric: Hand feeling Point | Adhesive strength to other materials: aluminum foil kg/5 cm | Kraft paper Kg/5 cm | rayon woven fabric Kg/5 cm | glass woven fabric Kg/5 cm |
|---|---|---|---|---|---|---|---|
| Ex. 1 | 2 | 78 | 8 | 2.6 | 7.9 | 6.7 | 3.5 |
| Ex. 2 | 1 | 71 | 9 | 1.2 | 2.7 | 2.1 | 0.9 |
| Ex. 3 | 0 | 68 | 10 | 0.7 | 1.9 | 1.7 | 0.6 |
| Ex. 4 | 0 | 65 | 9 | 1.4 | 2.8 | 2.3 | 1.0 |
| Ex. 5 | 0 | 62 | 10 | 0.6 | 2.3 | 1.8 | 0.7 |
| Ex. 6 | 2 | 75 | 8 | 2.8 | 8.0 | 7.0 | 4.0 |
| Ex. 7 | 0 | 66 | 8 | 1.3 | 2.5 | 1.8 | 0.9 |
| Ex. 8 | 1 | 63 | 8 | 1.9 | 3.3 | 2.6 | 1.6 |
| Ex. 9 | 1 | 62 | 10 | 0.7 | 1.8 | 1.7 | 0.6 |
| Co Ex. 1 | 35 | 153 | 1 | 2.4 | 7.7 | 6.1 | 3.1 |
| Co Ex. 2 | 8 | 112 | 3 | 1.1 | 2.4 | 1.8 | 0.8 |
| Co Ex. 3 | 15 | 88 | 4 | 0.3 | 1.1 | 0.9 | 0.3 |
| Co Ex. 4 | 1 | 68 | 7 | 0 | 0.5 | 0 | 0 |

Marks used in Tables 1 and 2 represent the following meaning.

[THE MARKS USED IN TABLE 1]

PP: isotactic polypropylene (MFR is 35)

PET: polyethylene terephthalate (IV is 0.63 and the melting point is 255° C.)

HDPE: high density polyethylene (MI is 26)

LLDPE: linear low density polyethylene (MI is 30)

LDPE: low density polyethylene (MI is 35)

[THE MARKS USED IN TABLE 2]

Copolymer: ethylene-ethyl acrylate-maleic anhydride terpolymer (E-EA-MAH), wherein E denotes ethylene, EA denotes ethyl acrylate, and MAH denotes maleic anhydride.

EH1: EA ratio is 9.5 wt. %, MAH ratio is 2.5 wt. % and the melting point is 102° C.

EH2: EA ratio is 21.9 wt;. %, MAH ratio is 3.0 wt. % and the melting point is 80° C.

EH3: EA ratio is 22.9 wt. %, MAH ratio is 3.4 wt. % and the melting point is 78° C.

EH4: EA ratio is 29.4 wt. %, MAH ratio is 2.6 wt. % and the melting point is 680° C.

Moreover, Comparative Example 4 shows the non-woven fabric comprising core and sheath type conjugated filaments in which high density polyethylene (sheath component) was singly used as the first component and polypropylene (core component) was used as the second component.

The non-woven fabric comprising filaments obtained in Examples 1 to 9 of the present invention were used as the second sheet of a disposable diaper having a back sheet which comprises stretched film of linear low density polyethylene, an absorptive core layer composed of fluff pulp and high water absorptive resin and which was wrapped up by a cover made of tissue paper, a second sheet, and a top sheet comprising non-woven fabric comprising core and sheath type conjugated staple fibers in which staple fiber composed of high density polyethylene as a sheath component and polypropylene as a core component that were thermally adhered by a through air method (hot air heating method) laminated in this order. In this case, the second sheet was thermally adhered with the cover sheet and the cover made of tissue paper (the cover of the absorptive core layer) by the method of partial thermal compression with the multiple dots. When the wearing test was conducted on the obtained disposable diaper, the top sheet was not found to be loosening from its base, the top sheet was not attached to the private parts of the body, and there was no problem of clogging by the second sheet. Consequently, the paper diaper which is excellent in adhesive property between the second sheet and the cover sheet and between the second sheet and the cover of the absorptive core layer could be obtained.

INDUSTRIAL APPLICABILITY

The non-woven fabric comprising filaments of the present invention comprises a first component that contains not less than 20 weight % of ethylene-acrylic ester-maleic anhydride copolymer and in which the first component is formed in at least a part of the filament surface in the longitudinal direction of the filament and a second component that is a crystalline thermoplastic resin having a melting point higher than that of the first component. At least the first component contains an inorganic powder and the content of said inorganic powder is 500 to 50000 weight ppm in the concentration with respect to filament. By such an embodiment, a non-woven fabric comprising filaments, which is excellent in high adhesive property, low temperature adhesive property, which has excellent hand feeling such as softness, touch etc., and which is an excellent in adhesion to the other kind of materials can be provided.

In the non-woven fabric comprising filaments of the present invention, by the preferred embodiment, the copolymerizing composition of ethylene-acrylic ester-maleic anhydride copolymer has the ratio of maleic anhydride of 2 to 5 weight % and the ratio of acrylate of 6 to 30 wt. %, the non-woven fabric comprising filaments is obtained in which there is no problem that the melt spinning is difficult because the melting point is too low, the stickiness is not too large, and the necessary characteristics as the material constituting the filament surface is satisfied. The thermal stability is relatively high, so that thermal decomposition or deterioration in quality does not occur in melt spinning. Thermal adhesion to other kinds of material is excellent, and the above mentioned effects can preferably be exhibited.

In the non-woven fabric comprising filaments of the present invention, by the preferred embodiment wherein a melting point of ethylene-acrylic ester-maleic anhydride copolymer is in the range of 60 to 110° C., the non-woven fabric comprising filaments easily can be obtained due to the excellent spinning property. In addition, the obtained non-woven fabric comprising filaments is excellent in adhesion.

In the non-woven fabric comprising filaments of the present invention, by the preferred embodiment wherein a resin component of the first component is a mixture of ethylene-acrylic ester-maleic anhydride copolymer and polyethylene, the friction between metal such as the above mentioned air sucker and filaments is more reduced, and adhesion between filaments in melt spinning can preferably be prevented by using polyethylene.

Moreover, in the non-woven fabric of the present invention, by the preferred embodiment where the average particle diameter of the inorganic powder is in the range of 0.04 to 2 $\mu$m, when compared with the case using inorganic powder having smaller particle diameter, the cost is less increased, the secondary coagulation of inorganic powder or clogging in the filter or the spinning nozzle does not, occur, and the operating efficiency due to the filament breakage is not deteriorated. When compared with the case using inorganic powder having larger particle diameter, there is no fear that the dispersion of inorganic powder is deteriorated, the clogging in the filter or the spinning nozzle occurs, or the operating efficiency due to the filament breakage is deteriorated, so that the above mentioned effects are sufficiently attained.

Moreover, in the non-woven fabric comprising filaments of the present invention, by the preferred embodiment wherein the inorganic powder is at least one inorganic powder selected from the group consisting of titanium dioxide, silica, alum, calcium carbonate, calcium oxide, magnesium oxide and talc, a non-woven fabric can be obtained in which these inorganic powders have the relatively low nucleating efficiency, so that the increase in the crystallization temperature of the resin constituting the first component containing not less than 20 wt. % of ethylene-acrylic ester-maleic anhydride copolymer hardly is generated, and the increase in the crystallization degree is remarkably small. Therefore, the properties of the resin of the first component as the low melting point resin or as low softening point resin, namely softness, excellent adhesive property, good adhesive property in low temperature etc. are not easily damaged and the non-woven fabric whose hand feeling such as softness or touch etc. is good and the adhesive property to the other members is excellent can be obtained.

Moreover, in the non-woven fabric comprising filaments of the present invention, by the preferred embodiment wherein the crystalline thermoplastic resin of the second component is polypropylene, the relatively soft non-woven fabric comprising filaments can be obtained.

Moreover, in the non-woven fabric comprising filaments of the present invention, by the preferred embodiment wherein the crystalline thermoplastic resin of the second component is polyethylene terephthalate, the non-woven fabric comprising filaments having the higher strength and more excellent elasticity (cushion property) at the time crimps are provided can be obtained.

Moreover, in the non-woven fabric comprising filaments of the present invention, by the preferred embodiment wherein the non-woven fabric comprising filaments is obtained by the spun bond method, the non-woven fabric having an excellent mechanical strength such as tensile strength can easily be obtained, and the productivity of the non-woven fabric comprising filaments is good and the non-woven fabric having excellent properties mentioned above can be produced at relatively low cost because filaments obtained by melt spinning are opened and accumulated directly. At the same time, the above mentioned effects are particularly effectively exhibited by the spun bond method and shortcomings of the conventional non-woven fabric comprising conjugated filaments obtained by the spun bond method can be improved.

Moreover, the absorbent article of the present invention can avoid the problems of the conventional absorbent articles and can provide the absorbent articles in which the clogging does not occur, the adhesion to the other members is good, and there are no problems in use, for example, layers constituting the absorbent article being peeled off or the layer structure being broken, by using the above mentioned non-woven fabric comprising filaments for at least a part of the absorbent article.

What is claimed is:

1. A filament non-woven fabric comprising thermally adhesive conjugated filaments, the filaments comprising a first component that contains not less than 20 weight % of ethylene-acrylic ester-maleic anhydride copolymer that, is formed in at least a part of the filament surface in the longitudinal direction of the filament and a second component that is a crystalline thermoplastic resin having a melting point higher than that of the first component; wherein at least the first component contains an inorganic powder and the content of said inorganic powder is 500 to 50000 weight ppm with respect to the filament as a whole.

2. The non-woven fabric comprising filaments according to claim 1, wherein the copolymerizing composition of ethylene-acrylic ester-maleic anhydride copolymer has a ratio of maleic anhydride of 2 to 5 weight % and a ratio of acrylate of 6 to 30 weight %.

3. The non-woven fabric comprising filaments according to claim 1, wherein a melting point of the ethylene-acrylic ester-maleic anhydride copolymer is in the range of 60 to 110° C.

4. The non-woven fabric comprising filaments according to claim 1, wherein a resin component of the first component is a mixture of ethylene-acrylic ester-maleic anhydride copolymer and polyethylene.

5. The non-woven fabric comprising filaments according to claim 1, wherein the average particle diameter of the inorganic powder is in the range of 0.04 to 2 $\mu$m.

6. The non-woven fabric comprising filaments according to claim 1, wherein the inorganic powder is at least one inorganic powder selected from the group consisting of titanium dioxide, silica, alum, calcium carbonate, calcium oxide, magnesium oxide and talc.

7. The non-woven fabric comprising filaments according to claim 1, wherein the crystalline thermoplastic resin of the second component is polypropylene.

8. The non-woven fabric comprising filaments according to claim 1, wherein the crystalline thermoplastic resin of the second component is polyethylene terephthalate.

9. The non-woven fabric comprising filaments according to claim 1, which is obtained by the spun bond method.

10. An absorbent article comprising the non-woven fabric comprising filaments according to claim 1 for at least one portion of the absorbent article.

* * * * *